US008890417B2

(12) United States Patent
Hu et al.

(10) Patent No.: US 8,890,417 B2
(45) Date of Patent: Nov. 18, 2014

(54) LED BACKLIGHT DRIVING CIRCUIT, BACKLIGHT MODULE, AND LCD DEVICE

(71) Applicant: Shenzhen China Star Optoelectronics Technology Co., Ltd, Shenzhen (CN)

(72) Inventors: Anle Hu, Shenzhen (CN); Fei Li, Shenzhen (CN)

( * ) Notice: Subject to any disclaimer, the term of this patent is extended or adjusted under 35 U.S.C. 154(b) by 60 days.

(21) Appl. No.: 13/806,807

(22) PCT Filed: Nov. 23, 2012

(86) PCT No.: PCT/CN2012/085152

§ 371 (c)(1), (2), (4) Date: Dec. 24, 2012

(87) PCT Pub. No.: WO2014/079038

PCT Pub. Date: May 30, 2014

(65) Prior Publication Data

US 2014/0139110 A1 May 22, 2014

(30) Foreign Application Priority Data

Nov. 22, 2012 (CN) ..... 2012 1 0478373

(51) Int. Cl.
*H05B 37/02* (2006.01)
*H05B 41/36* (2006.01)
*H05B 33/08* (2006.01)

(52) U.S. Cl.
CPC ..... *H05B 33/0851* (2013.01)
USPC ..... 315/122; 315/185 R; 315/307; 315/224; 315/291

(58) Field of Classification Search
CPC ..... H05B 37/02; H05B 37/00
USPC ..... 315/297, 312, 244
See application file for complete search history.

(56) References Cited

U.S. PATENT DOCUMENTS

| | | | | |
|---|---|---|---|---|
| 7,327,051 | B2 * | 2/2008 | Ito et al. | 307/10.8 |
| 2007/0085786 | A1 * | 4/2007 | Lin et al. | 345/82 |
| 2010/0072903 | A1 * | 3/2010 | Blaut et al. | 315/185 R |
| 2010/0164403 | A1 * | 7/2010 | Liu | 315/297 |
| 2011/0227497 | A1 * | 9/2011 | Hu et al. | 315/224 |
| 2012/0013267 | A1 * | 1/2012 | Yoshio et al. | 315/297 |
| 2012/0206055 | A1 * | 8/2012 | Tseng | 315/186 |

FOREIGN PATENT DOCUMENTS

| | | | |
|---|---|---|---|
| CN | 101801145 | A | 8/2010 |
| CN | 102123536 | A | 7/2011 |
| CN | 201927998 | U | 8/2011 |
| CN | 102446492 | A | 5/2012 |
| CN | 102637412 | A | 8/2012 |
| CN | 102740567 | A | 10/2012 |

OTHER PUBLICATIONS

Zhong Yangxue, the International Searching Authority written comments, Aug. 2013, CN.

* cited by examiner

*Primary Examiner* — Douglas W Owens
*Assistant Examiner* — Wei Chan

(57) ABSTRACT

A light emitting diode (LED) backlight driving circuit includes an LED lightbar, and a constant current chip that controls current flowing through the LED lightbar. The LED backlight driving circuit further includes a comparison module that receives an output voltage of the LED lightbar. When the output voltage of the LED lightbar is greater than the preset reference voltage, the comparison module controls the constant current chip to switch off the current of the LED lightbar.

15 Claims, 2 Drawing Sheets

LED BACKLIGHT DRIVING CIRCUIT, BACKLIGHT MODULE, AND LCD DEVICE

TECHNICAL FIELD

The present disclosure relates to the field of a liquid crystal displays (LCD), more particularly to a light emitting diode (LED) backlight driving circuit, a backlight, module, and an LCD device.

BACKGROUND

A liquid crystal display (LCD) device includes an LCD panel and a backlight module providing a light source to the LCD panel. Because a light emitting diode (LED) is associated with reduced costs, a typical backlight module mainly uses the LED as a light source. The light source is a lightbar formed via a plurality of the LEDs connected in series, and a boost circuit drives the lightbar to emit light. An output end of the LED is connected in series with a metal-oxide-semiconductor field-effect transistor (MOSFET), a constant current chip is used to control switch off the MOSFET, and an effective current flowing through the LED lightbar is controlled via adjusting a duty ratio of the MOSFET, which can dim the LEDs. When one or more LEDs of the LED lightbar are short-circuited, brightness of entire LED lightbar is reduced. However, at this moment, the constant current chip may not switch off current of the LED lightbar, which reduces comfort level for user to watch, and affects the constant current chip and related circuit boards.

SUMMARY

In view of the above-described problems, the aim of the present disclosure is to provide a light emitting diode (LED) backlight driving circuit, a backlight module, and a liquid crystal display (LCD) device capable of achieving the aim of LED short circuit protection.

The aim of the present disclosure is achieved by the following technical scheme.

An LED backlight driving circuit comprises an LED lightbar, and a constant current chip that controls current flowing through the LED lightbar. The LED backlight driving, circuit further comprises a comparison module that receives an output voltage of the LED lightbar. When the output voltage of the LED lightbar is greater than a preset reference voltage, the comparison module controls the constant current chip to switch off the current of the LED lightbar.

In one example, the comparison module comprises a comparator, one input end of the comparator is coupled to the reference voltage, and a second input end of the comparator is coupled to an output end of the LED lightbar. The comparator controls the constant current chip by comparing the reference voltage with the output voltage of the LED lightbar. This is a specific circuit structure of the comparison module.

In one example, a non-inverting input end of the comparator is connected to the reference voltage, and an inverting input end of the comparator is coupled to the output end of the LED lightbar. When the output voltage of the LED lightbar is greater than the reference voltage, the comparator outputs a low level signal to an enable control end of the constant current chip to control the constant current chip to switch off the current of the LED lightbar. This is a specific circuit structure of the comparator and the constant current chip. By using the enable control end of the constant current chip, switch of the constant current chip is controlled by a simple high/low level signal, which is a simple control method, reduces and simplifies control circuit, and reduces cost of development and design.

In one example, a non-inverting input end of the comparator is coupled to an operation power source end of the constant current chip, and the reference voltage is supplied power by an operation power source of the constant current chip. An operation of the constant current chip requires a constant operation power source. Therefore, by using the operation power source as the reference voltage, the circuit is reused, the control circuit is further simplified, and the cost is reduced.

In one example, a first resistor and a second resistor are connected in series between the operation power source end of the constant current chip and a grounding end of the LED backlight driving circuit in sequence, and voltage of the second resistor is coupled to the non-inverting, input end of the comparator. This is a resistance voltage divider (RVD) circuit, and the operation voltage of the constant current chip is constant and unchangeable. However, in fact, because schemes for LED short circuit protection are different, different reference voltages are set, for example, when a single LED is short-circuited and when more than two LEDs are short-circuited, the corresponding reference voltages used to actuate short circuit protection are different. Moreover, because voltage divider circuit is used, different reference voltages are obtained by adjusting a ratio of resistance between the first resistor and the second resistor, which make application scope of the present disclosure expand.

In one example, the second resistor is an adjustable resistor. Thus, it is not needed to consider different protection schemes during design. Resistance of the second resistor is adjusted in accordance with a required protection scheme in practical use, which obtains required reference voltages, and facilitates subsequent manufacture and maintenance.

In one example, a non-inverting input end of the comparator is connected to a reference voltage, and an inverting input end of the comparator is coupled to the output end of the LED lightbar. When the output voltage of the LED lightbar is greater than the reference voltage, the comparator outputs a low level signal to an enable control end of the constant current chip to control the constant current chip to switch of the current of the LED lightbar. A first resistor and a second resistor are connected in series between an operation power source end of the constant current chip and a grounding end of the LED backlight driving circuit in sequence, and the voltage of the second resistor is coupled to the non-inverting input end of the comparator. The second resistor is an adjustable resistor. This is a specific example.

In one example, a dimming controllable switch and a third resistor are connected in series between the output end of the LED lightbar and the grounding end of the LED backlight driving circuit in sequence. When the output voltage of the LED lightbar is greater than the preset reference voltage, the constant current chip controls the dimming controllable switch to switch off. This is a specific dimming control scheme.

A backlight module comprises the LED backlight driving circuit mentioned above.

An LCD device comprises the backlight module mentioned above.

Because the present disclosure uses the comparison module, and the comparison module receives the output voltage of the LED lightbar, when one or more LEDs of the LED lightbar are son-circuited, the output voltage of the entire LED lightbar may be increased. Thus, the preset reference voltage should be greater than normal output voltage of the LED lightbar. The comparison module controls the constant current chip to switch of the current of the LED lightbar when the comparison module detects that the output voltage of the LED lightbar is greater than the preset reference voltage, namely a light source of the backlight module is turned off, which achieves the LED short circuit protection, and further avoids damaging the constant current chip and related circuit boards.

DETAILED DESCRIPTION

Figure 1:
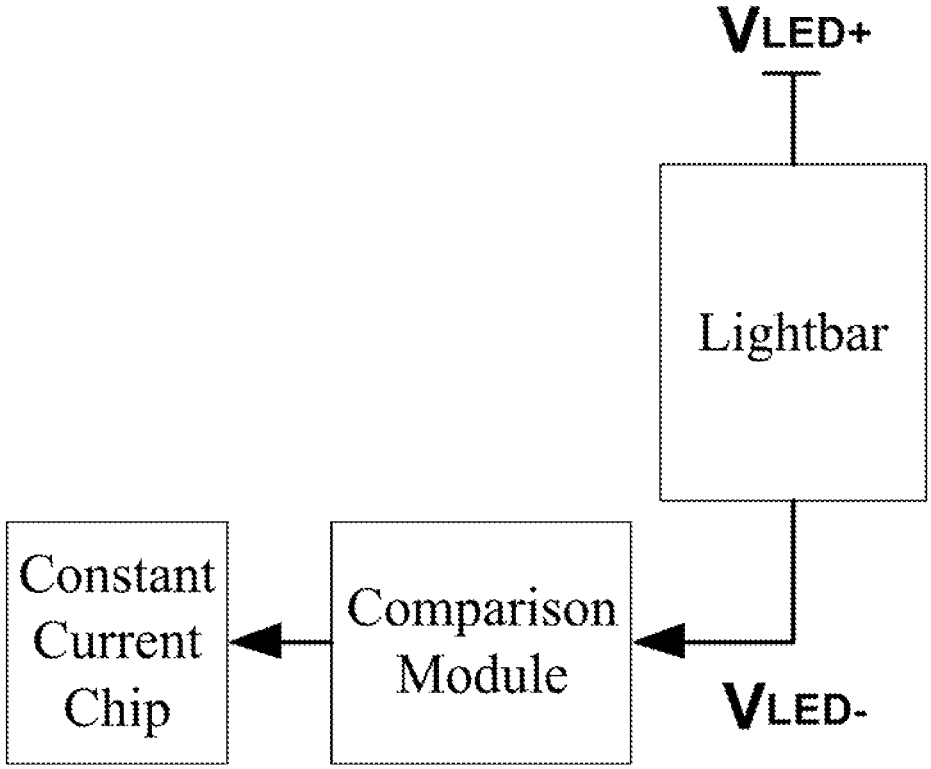
FIG. 1 is a block diagram of an overall structure of a light emitting diode (LED) backlight driving circuit of an example of the present disclosure.

As shown in FIG. 1, the present disclosure provides a liquid crystal display (LCD) device, comprising a backlight module. The backlight module comprises a light emitting diode (LED) backlight driving circuit. The LED backlight driving circuit comprises an LED lightbar, and a constant current chip that controls current flowing through the LED lightbar. The LED backlight driving circuit further comprises a comparison module that receives an output voltage of the LED lightbar. When the output voltage of the LED lightbar is greater than a preset reference voltage, the comparison module controls the constant current chip to switch off the current of the LED lightbar.

Because the present disclosure adopts the comparison module that receives the output voltage of the LED lightbar, when one or more LEDs of the LED lightbar are short-circuited, the output voltage of the entire LED lightbar may be increased. Thus, the preset reference voltage should be greater than a normal output voltage, of the LED lightbar. The comparison module controls the constant current chip to switch off the current of the LED lightbar when the comparison module detects that the output voltage of the LED lightbar is greater than the preset reference voltage, namely a light source of the backlight module is turned off, which achieves LED short circuit protection. At this moment, users can go to a repair or maintenance facility for maintenance to eliminate failure.

The present disclosure will further be described in detail in accordance with the figures and the preferable examples.

Figure 2:
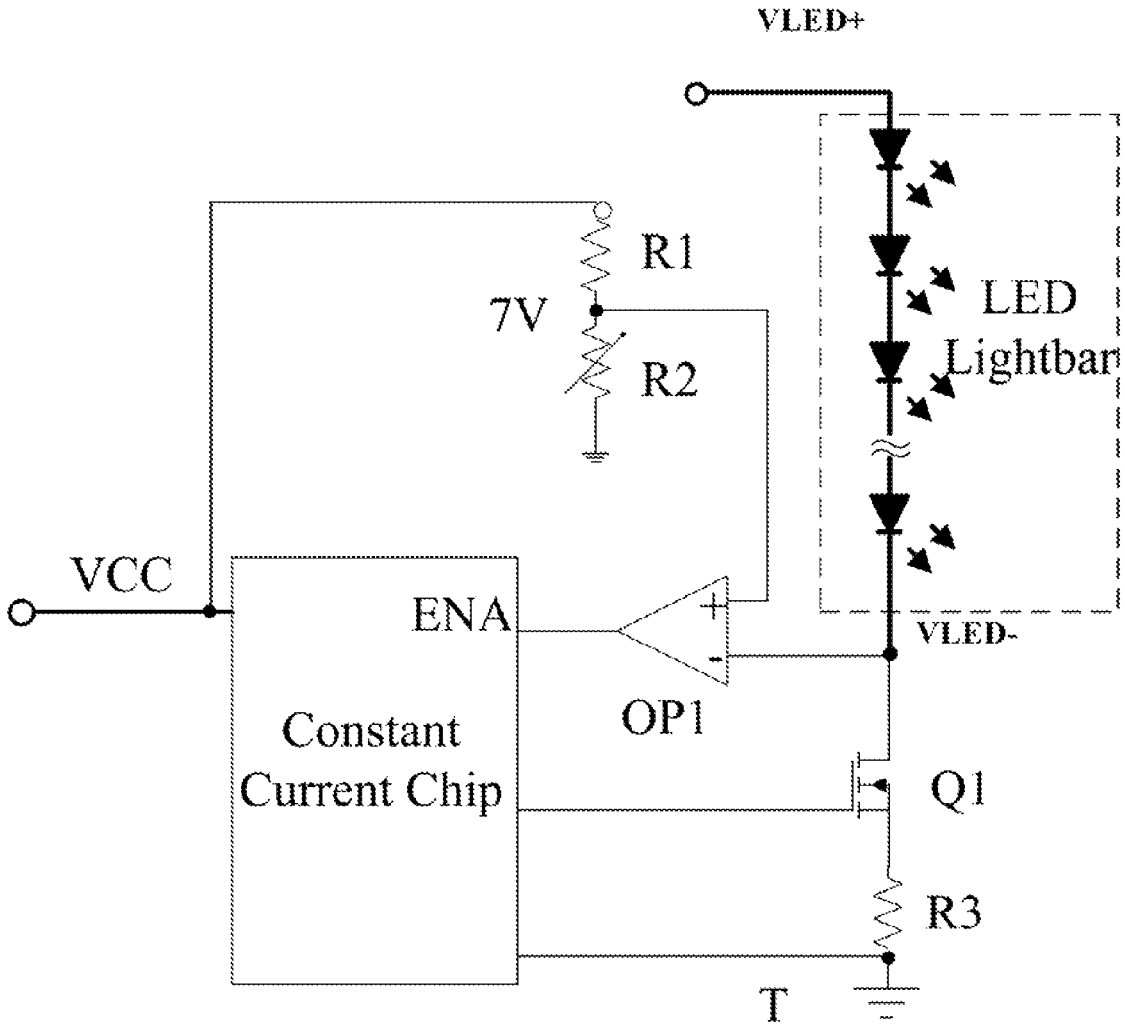
FIG. 2 is a structural diagram of the LED backlight driving circuit of the example of present disclosure.

As shown in FIG. 2, an LED backlight driving circuit of the example comprises an LED lightbar, and a constant current chip that controls current flowing through the LED lightbar. The LED backlight driving circuit further comprises a comparison module. The LED lightbar is formed via a plurality of LEDs connected in series. An input end of the LED lightbar is input voltage VLED+, and an output voltage of the LED lightbar is VLED−. A dimming controllable switch Q1 and a third resistor R3 are connected in series between the output end of the LED lightbar and a grounding end of the LED backlight driving, circuit in sequence.

A first resistor R1 and a second resistor R2 are connected in series between an operation power source end VCC. of the constant current chip and the grounding end GND of the LED backlight driving circuit in sequence. The comparison module comprises a comparator OP1. An inverting input end of the comparator OP1 is connected to the VLED−, a non-inverting input end of the comparator OP1 is connected between the first resistor R1 and the second resistor R2, and the comparator OP1 receives a voltage of the second resistor R2 as a reference voltage. When the output voltage VLED− of the LED lightbar is greater than the reference voltage, the comparator OP1 outputs a low level signal to an enable control end ENA of the constant current chip to control the constant current chip to switch off the current of the LED lightbar.

By using the enable control end of the constant current chip, of the constant current chip is controlled by a simple high/low level signal (logic 1/ logic 0), which is a simple control method, reduces and simplifies control circuit, and reduces cost of development and design. Operation of the constant current chip requires a constant operation power source. Therefore, by using the operation power source as the reference voltage, the circuit is reused, the control circuit is further simplified, and cost is reduced, An operation voltage of the constant current chip is constant and unchangeable. However, in fact, because schemes for LED short circuit protection are different, different reference voltages are set, for example, when a single LED is short-circuited and when more than two LEDs are short-circuited, the corresponding reference voltages used to actuate short circuit protection are different. Therefore, to expand application scope of the present disclosure, a voltage divider circuit is used, and different reference voltages are obtained within the VCC voltage scope by adjusting a ratio of resistance between the first resistor R1 and the second resistor R2.

The second resistor R2 is an adjustable resistor. Thus, it is not needed to consider different protection schemes during design. Resistance of the second resistor is adjusted in accordance with a required protection scheme in practical use, which obtains required reference voltages, and facilitates subsequent manufacture and maintenance.

Optionally, a source of the reference voltage of the present disclosure is not limited to the VCC. All the power sources that supplies stable voltage can be used as the source of the reference voltage of the present disclosure.

The present disclosure is described in detail in accordance with the above contents With the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

The invention claimed is:

1. A light emitting diode (LED) backlight driving circuit, comprising:

an LED lightbar; a constant current chip that controls current flowing through the LED lightbar; and a comparison module that receives an output voltage of the LED lightbar;

when the output voltage of the LED lightbar is greater than a reference voltage, the comparison module controls the constant current chip to switch off the current of the LED lightbar; wherein a non-inverting input end of the comparator is connected to the reference voltage, and an inverting input end of the comparator is coupled to the output end of the LED lightbar; when the output voltage of the LED lightbar is greater than the reference voltage, the comparator outputs a low level signal to an enable control end of the constant current chip to control the constant current chip to switch off the current of the LED lightbar; a first resistor and a second resistor are connected in series between an operation power source end of the constant current chip and a grounding end of the LED backlight driving circuit in sequence, and voltage of the second resistor is coupled to the non-inverting input end of the comparator; the second resistor is an adjustable resistor.

2. The light emitting diode (LED) backlight driving circuit of claim 1, wherein the comparison module comprises a comparator, one input end of the comparator is coupled to the reference voltage, and a second input end of the comparator is coupled to an output end of the LED lightbar; the comparator controls the constant current chip by comparing the reference voltage with the output voltage of the LED lightbar.

3. The light emitting diode (LED) backlight driving circuit of claim 2, wherein a non-inverting input end of the comparator is connected to the reference voltage, an inverting input end of the comparator is coupled to the output end of the LED lightbar; when the output voltage of the LED lightbar is greater than the reference voltage, the comparator outputs a low level signal to an enable control end of the constant current chip to control the constant current chip to switch off the current of the LED lightbar.

4. The light emitting diode (LED) backlight driving circuit of claim 2, wherein a non-inverting input end of the comparator is coupled to an operation power source end of the constant current chip, and the reference voltage is supplied power by an operation power source of the constant current chip.

5. The light emitting diode (LED) backlight driving circuit of claim 4, wherein a first resistor and a second resistor are connected in series between the operation power source end of the constant current chip and a grounding end of the LED backlight driving circuit in sequence, and voltage of the second resistor is coupled to the non-inverting input end of the comparator.

6. The light emitting diode (LED) backlight driving circuit of claim 5, wherein the second resistor is an adjustable resistor.

7. The light emitting diode (LED) backlight driving circuit of claim 1, wherein a dimming controllable switch and a third resistor are connected in series between the output end of the LED lightbar and the grounding end of the LED backlight driving circuit in sequence; when the output voltage of the LED lightbar is greater than the reference voltage, the constant current chip controls the dimming controllable switch to switch off.

8. A backlight module, comprising:

a light emitting diode (LED) backlight driving circuit comprising an LED lightbar, a constant current chip that controls current flowing through the LED lightbar, and a comparison module that receives an output voltage of the LED lightbar; when the output voltage of the LED lightbar is greater than a reference voltage, the comparison module controls the constant current chip to switch off the current of the LED lightbar; wherein a non-inverting input end of the comparator is connected to the reference voltage, and an inverting input end of the comparator is coupled to the output end of the LED lightbar; when the output voltage of the LED lightbar is greater than the reference voltage, the comparator outputs a low level signal to an enable control end of the constant current chip, to control the constant current chip to switch off the current of the LED lightbar; a first resistor and a second resistor are connected in series between an operation power source end of the constant current chip and a grounding end of the LED backlight driving circuit in sequence, and voltage of the second resistor is coupled to the non-inverting input end of the comparator; the second resistor is an adjustable resistor.

9. The backlight module of claim 8, wherein the comparison module comprises a comparator; one input end of the comparator is coupled to the reference voltage, and a second input end of the comparator is coupled to an output end of the LED lightbar; the comparator controls the constant current chip by comparing the reference voltage with the output voltage of the LED lightbar.

10. The backlight module of claim 9, wherein the a non-inverting input end of the comparator is connected to the reference voltage, and an inverting input end of the comparator is coupled to the output end of the LED lightbar; when the output voltage of the LED lightbar is greater than the reference voltage, the comparator outputs a low level signal to an enable control end of the constant current chip, to control the constant current chip to switch off the current of the LED lightbar.

11. The backlight module of claim 9, wherein a non-inverting input end of the comparator is coupled to an operation power source end of the constant current chip, and the reference voltage is supplied power by an operation power source of the constant current chip.

12. The backlight module of claim 11, wherein a first resistor and a second resistor are connected in series between the operation power source end of the constant current chip and a grounding end of the LED backlight driving circuit in sequence, and a voltage of the second resistor is coupled to the non-inverting input end of the comparator.

13. The backlight module of claim 12, wherein the second resistor is an adjustable resistor.

14. The backlight module of Claim 8, wherein a dimming controllable switch and a third resistor are connected in series between the output end of the LED lightbar and the grounding end of the LED backlight driving circuit in sequence; when the output voltage of the LED lightbar is greater than the reference voltage, the constant current chip controls the dimming controllable switch to switch off.

15. A liquid crystal display (LCD) device, comprising: a backlight module comprising a light emitting diode (LED) backlight driving circuit comprising an LED lightbar, a constant current chip that controls current flowing through the LED lightbar, and a comparison module that receives an output voltage of the LED lightbar; when the output voltage of the LED lightbar is greater than a reference voltage, the comparison module controls the constant current chip to switch off the current of the LED lightbar; wherein a non-inverting input end of the comparator is connected to the reference voltage, and an inverting input end of the comparator is coupled to the output end of the LED lightbar; when the output voltage of the LED lightbar is greater than the reference voltage, the comparator outputs a low level signal to an enable control end of the constant current chip, to control the constant current chip to switch off the current of the LED lightbar; a first resistor and a second resistor are connected in series between an operation power source end of the constant current chip and a grounding end of the LED backlight driving circuit in sequence, and voltage of the second resistor is coupled to the non-inverting input end of the comparator; the second resistor is an adjustable resistor.

* * * * *